United States Patent [19]

Frame

[11] 4,405,849

[45] Sep. 20, 1983

[54] SWITCHING CONTACT

[75] Inventor: Norman J. Frame, Whitefish Bay, Wis.

[73] Assignee: W. H. Brady Co., Milwaukee, Wis.

[21] Appl. No.: 355,511

[22] Filed: Mar. 8, 1982

[51] Int. Cl.[3] ..... H01H 1/02

[52] U.S. Cl. ..... 200/262; 200/268; 428/627; 428/929

[58] Field of Search ..... 200/262, 265, 266, 267, 200/268, 270; 427/78; 204/192 C, 192 SP, 192 F

[56] References Cited

U.S. PATENT DOCUMENTS

| | | | |
|---|---|---|---|
| 3,627,963 | 12/1971 | Lindsay | 200/268 |
| 3,701,931 | 10/1972 | Revitz et al. | 428/627 X |
| 4,169,032 | 9/1979 | Haase et al. | 204/192 F |
| 4,180,711 | 12/1979 | Hirata et al. | 200/267 X |
| 4,209,552 | 6/1980 | Welch | 427/78 |
| 4,243,861 | 1/1981 | Strandwitz | 200/267 X |

FOREIGN PATENT DOCUMENTS

| | | | |
|---|---|---|---|
| 5124213 | 10/1980 | Japan | 200/268 |
| 6159016 | 12/1981 | Japan | 200/262 |
| 6159017 | 12/1981 | Japan | 200/268 |
| 6159028 | 12/1981 | Japan | 200/268 |

OTHER PUBLICATIONS

R. Petrovic et al., *Electrical and Structural Properties of Tantalum Nitride Thin Films Deposited by Sputtering,* Thin Films, p. 333–336, 1979.

Witold Posadowski et al., *Properties of TiNx Films Reactively Spattered in an Argon–Nitrogen Atmosphere,* Thin Solid Films, pp. 347–351, 1979.

*Primary Examiner*—John W. Shepperd

*Assistant Examiner*—Renee S. Kidorf

[57] ABSTRACT

A flexible multilayered membrane switch having electrically conducting contacts comprising $Ti_{2-x}N$ or $Ta_{2-x}N$, to reduce oxidation of the surfaces of the contacts.

6 Claims, 3 Drawing Figures

FIG 1
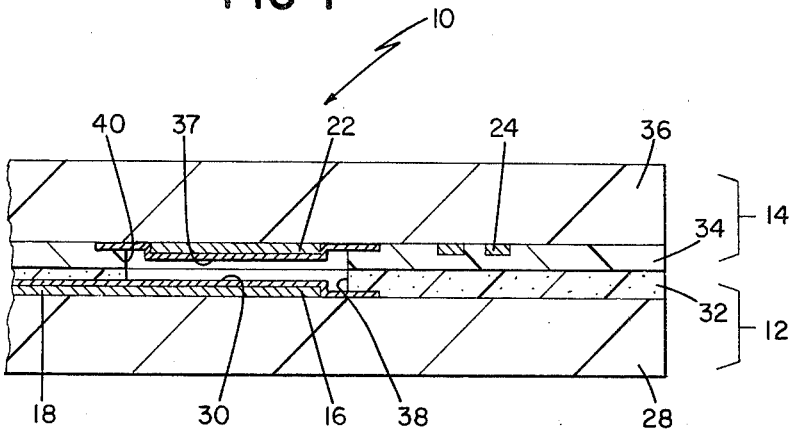
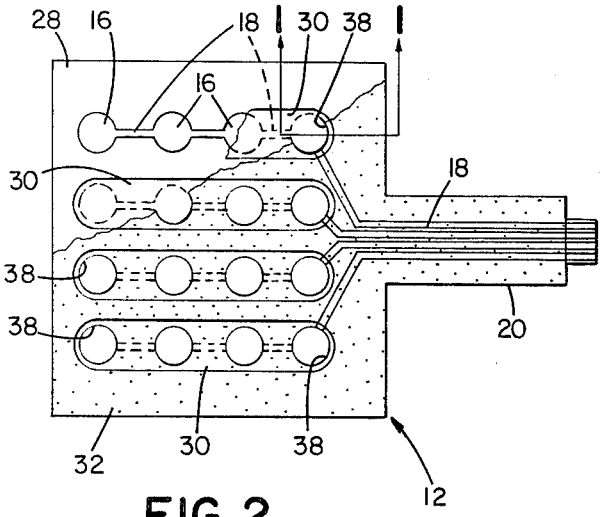
FIG 2
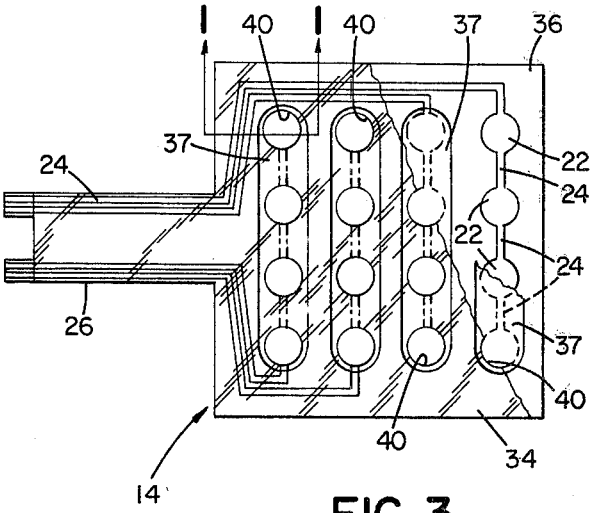
FIG 3

SWITCHING CONTACT

FIELD OF THE INVENTION

The invention relates to electrical switches comprising contact layers of $Ti_{2-x}N$ or $Ta_{2-x}N$, particularly flexible multilayered membrane switches.

BACKGROUND OF THE INVENTION

Continuous oxide layers can form on the surface of electrically conducting contacts of switches, thereby requiring an increased force to achieve electrical connection between two such contacts when pushed together. In the past some contacts have been covered with gold to alleviate this problem.

SUMMARY OF THE INVENTION

I have discovered that such oxidation problems can be avoided by using $Ti_{2-x}N$ or $Ta_{2-x}N$ as the surfaces of the contacts. These, as coatings, in addition to being economical, are wear resistant and provide sufficient conduction of electricity at the same time that they resist the formation of oxides. In preferred embodiments the coatings are radio frequency sputtered in the presence of nitrogen. In some preferred embodiments the electrically conducting contacts are made of copper, and in some other preferred embodiments there also are thin layers of titanium or tantalum between the $Ti_{2-x}N$ or the $Ta_{2-x}N$ coatings and the rest of the electrically conducting contacts.

DESCRIPTION OF THE PREFERRED EMBODIMENT

The structure, manufacture, and use of the presently preferred embodiment will now be described after first briefly describing the drawings.

DRAWINGS

FIG. 1 is a diagrammatical vertical sectional view, taken at 1—1 of FIGS. 2 and 3, showing the structure of a switching element of a membrane switch.

FIGS. 2 and 3 are top and bottom plan views of subassemblies of the membrane switch during manufacture.

STRUCTURE

Referring to the figures, in FIG. 1 there is shown portion 10 of a multilayered membrane switch made by joining together subassemblies 12, 14, shown in FIGS. 2 and 3.

Subassembly 12 has a plurality of electrically conducting switch contacts 16 connected in rows by conducting portions 18 that end in tail portion 20. Subassembly 14 similarly has corresponding switching contacts 22 connected in columns by electrically conductive portions 24 that end in tail portion 26.

The assembled switch has lower layer 28 of polyester 5 mils thick; a 2,000 Angstrom thick layer of copper thereon to provide contacts 16 and conducting portions 18; 400 Angstrom thick titanium nitride coatings 30 on contacts 16; one mil thick layer 32 of adhesive deposited on polyester layer 28 except for areas near the contacts; one mil thick epoxy spacer layer 34 on top of layer 32; and upper 5 mil thick polyester layer 36, on the bottom surface of which is adhered a 2,000 Angstrom thick layer of copper to provide contacts 22 and conducting portions 24. On the bottom surfaces of contacts 22 there also are 400 Angstrom thick coatings 37 of titanium nitride. Contacts 16, 22 are normally spaced from each other and are located in holes 38 of adhesive layer 32 and holes 40 of spacer layer 34.

MANUFACTURE

Copper is vacuum deposited through a suitable deposition mask onto the surfaces of polyester layers 28, 36, to provide contacts 16, 22 and conducting portions 18, 24 at the locations shown in FIGS. 2 and 3. Titanium nitride is then applied to the upper surfaces of contacts 16, 22 by radio frequency sputtering titanium in a nitrogen atmosphere through a suitable deposition mask to form coatings 30, 37. The sputtered coatings are mixtures of TiN and $Ti_2N$, and can be described by the designation $Ti_{2-x}N$, where X is less than or equal to 1. Adhesive layer 32 and epoxy spacer layer 34 are both silk screen deposited onto layers 28, 36. Spacer layer 34 is thermally cured, and subassemblies 12 and 14 are brought together and are adhered to each other by adhesive layer 32.

USE

In use the switch is mounted on a surface, and tail portions 20, 26 are connected to external detection circuitry via a double-sided connector that has portions making electrical contact with conductive portions 18, 24. When a force is applied to the upper surface of polyester layer 36 in the vicinity of an aligned pair of electrical contacts 16, 22, the contacts are brought together, thereby completing a circuit between them. Titanium nitride coatings 30, 37 conduct electricity and cover the exposed surfaces of contacts 16, 22 to protect them from the formation of oxide layers on their surfaces, which oxide layers would otherwise inhibit the making of electrical contact and require that larger forces be used to activate the switch.

OTHER EMBODIMENTS

Other embodiments of the invention will become apparent to those skilled in the art. For example, the contacts could be made of other base metals in addition to copper. Also, a 200 Angstrom thick layer of titanium or tantalum could be deposited on the contacts prior to depositing the titanium nitride or tantalum nitride coatings to improve adhesion, particularly when a material other than copper is used.

What is claimed is:

1. A multilayered membrane switch comprising a pair of plastic layers carrying pairs of opposing electrically conducting contacts connected to external circuitry by conducting portions on the surfaces of said plastic layers, a spacer layer between said pair of plastic layers and having openings aligned with said pairs of opposing contacts to normally space said contacts from each other and to permit them to be brought together upon the application of an external force, and coatings on and extending over said contacts onto adjacent portions of said plastic layers and onto portions of said conducting portions within said openings, said coatings being made of one of $Ti_{2-x}N$ or $Ta_{2-x}N$ material to reduce oxidation of the surfaces of said contacts and conducting portions, where x is less than or equal to 1.

2. The switch of claim 1 in which said material is sputtered in the presence of nitrogen.

3. The switch of claim 2 in which said material is $Ti_{2-x}N$ radio frequency sputtered in the presence of nitrogen.

4. The switch of claim 1 in which said contacts and conducting portions are vacuum deposited thin films.

5. The switch of claim 4 in which said material is coated on copper.

6. The switch of claim 3 comprising a thin layer of titanium beneath said material.

* * * * *